US005441061A

United States Patent [19]

Jordan et al.

[11] Patent Number: 5,441,061

[45] Date of Patent: Aug. 15, 1995

[54] INTERCHANGEABLE DECORATIVE ORNAMENT AND METHOD

[75] Inventors: Gina M. Jordan; Tracie L. Eakin, both of Flower Mound; Tomima L. Edmark, Dallas, all of Tex.

[73] Assignee: The Topsytail Company, Dallas, Tex.

[21] Appl. No.: 190,911

[22] Filed: Feb. 3, 1994

[51] Int. Cl.[6] ..... A45D 8/12; A45D 8/20

[52] U.S. Cl. ..... 132/275; 132/277; D28/40

[58] Field of Search ..... 132/273, 274, 275, 276, 132/277, 278, 279, 280, 281, 282, 283, 284; D28/39, 40, 41, 42, 43

[56] References Cited

U.S. PATENT DOCUMENTS

| | | | |
|---|---|---|---|
| D. 26,504 | 1/1897 | Postert | D11/1 |
| D. 39,554 | 9/1908 | Farrell . | |
| D. 93,176 | 8/1934 | Murray | D11/75 |
| D. 121,818 | 8/1940 | Marrow | D11/143 X |
| D. 141,169 | 5/1945 | Petitta | D28/39 |
| D. 144,284 | 4/1946 | Behr | D28/42 |
| D. 178,266 | 7/1956 | Erenhouse | D28/39 |
| D. 343,508 | 1/1994 | Jones | D2/606 |
| D. 348,121 | 6/1994 | Park | D28/40 |
| 401,649 | 4/1889 | Hackett . | |
| 565,884 | 8/1896 | Emmons . | |
| 651,764 | 6/1900 | Mullinix . | |
| 672,816 | 4/1901 | Bassett . | |
| 717,499 | 12/1902 | Gouy . | |
| 818,468 | 4/1906 | Regan . | |
| 926,450 | 6/1909 | Yoemans . | |
| 979,422 | 12/1910 | Burke | 132/280 |
| 1,007,586 | 10/1911 | Martin . | |
| 1,039,910 | 10/1912 | Degenhardt . | |
| 1,055,428 | 3/1913 | Stone . | |
| 1,077,345 | 11/1913 | Hines et al. . | |
| 1,091,936 | 3/1914 | Lange | 132/275 |
| 1,221,172 | 4/1917 | Hamilton . | |
| 1,255,348 | 2/1918 | Stone . | |
| 1,316,981 | 9/1919 | Singer . | |
| 1,353,912 | 9/1920 | Kelley . | |
| 1,480,935 | 1/1924 | Gleason . | |
| 1,808,156 | 6/1931 | Burns | 132/275 |
| 1,863,878 | 6/1932 | Riley | 24/5 |
| 2,047,825 | 7/1936 | Johnson et al. | 24/6 |
| 2,272,514 | 2/1942 | Davis . | |
| 2,661,748 | 12/1953 | Racho | 132/48 |
| 4,991,607 | 2/1991 | Chen | 132/278 |
| 5,238,044 | 8/1993 | Gilley et al. . | |
| 5,318,054 | 6/1994 | Neilson et al. | 132/273 |

FOREIGN PATENT DOCUMENTS

| | | | |
|---|---|---|---|
| 396429 | 1/1909 | France | 132/275 |
| 472857 | 12/1914 | France . | |
| 537622 | 3/1922 | France . | |
| 543333 | 6/1922 | France | 132/275 |
| 2748601 | 5/1979 | Germany | 132/277 |
| 200829 | 2/1924 | United Kingdom . | |

OTHER PUBLICATIONS

Newspaper article, John Taylor, "Woman's Barrette Has a Twist", Jan. 15, 1994, Omaha, Neb., World Herald, Morning Edition.

*Primary Examiner*—John G. Weiss
*Attorney, Agent, or Firm*—Baker & Botts

[57] ABSTRACT

A decorative ornament (10) for displaying a decorative element (12) is provided. Decorative ornament (10) comprises a coupling member (14) for coupling the decorative ornament (10) for display. Decorative ornament (10) further comprises a plurality of holding members (16) having openings (20). Holding members (16) are spaced apart to provide uninterrupted regions (22) between adjacent holding members (16). Decorative element (12) is threaded through openings (20). Decorative element (12) is further drawn through uninterrupted regions (22).

6 Claims, 3 Drawing Sheets

INTERCHANGEABLE DECORATIVE ORNAMENT AND METHOD

TECHNICAL FIELD OF THE INVENTION

This invention relates in general to the field of decorative ornaments, and more particularly to an interchangeable decorative ornament.

BACKGROUND OF THE INVENTION

It is a common practice for people to use a scarf or some other decorative material to ornament an outfit. Such decorative elements are made of various fabrics and are decorated with various prints, colors and patterns. Certain rules of fashion dictate that a particular decorative element will not go with every outfit. Some colors, styles and fabrics just do not look acceptable together.

A common problem encountered in using a scarf to ornament an outfit is that scarves are not easy to use. It is difficult to learn how to fold and attach a scarf to an outfit in an appropriate manner to provide an attractive appearance. Several video tapes have been developed in an attempt to teach people various techniques to use a scarf to ornament an outfit. These techniques are not easy and if not done properly, may not result in an attractive appearance.

There are several other problems with using a scarf, ribbon or other decorative fabric to ornament an outfit or hair. For example, such a decorative element may be tied in a user's hair to form, for example, a decorative bow. Unfortunately, a decorative element may easily loosen and fall out of the user's hair. Additionally, decorative elements are available in various shapes and sizes. Not all such decorative elements operate the same.

Therefore, a need has arisen for a fashion accessory that provides an easy and attractive way to use a decorative element to ornament an outfit or hair style.

SUMMARY OF THE INVENTION

In accordance with the present invention, an interchangeable decorative ornament is provided which substantially eliminates or reduces disadvantages and problems associated with prior ornaments and methods. More particularly, an embodiment of the present invention provides a decorative ornament comprising a decorative element such as a ribbon, piece of decorative fabric, or scarf. The decorative ornament also comprises a means for affixing the decorative ornament for display. Finally, the decorative ornament comprises a plurality of holding members coupled to the affixing means. Each of the holding members includes an opening for receiving the decorative element. The holding members are spaced apart by a predetermined distance to form uninterrupted regions between adjacent holding members. Therefore, the decorative element may be applied to the holding member in any number of ways. For example, the decorative element may be threaded through the openings in the holding members. Subsequently, the decorative element may be drawn through the uninterrupted regions between the holding members. In this manner, the decorative ornament of the present invention provides an attractive manner for displaying the decorative element. Alternatively, the decorative element may be tied to, or wrapped around the holding members.

A technical advantage of the present invention is that it provides an easy to use method for displaying a decorative element such as a scarf. The scarf may be threaded through the openings of the holding members. Subsequently, the scarf may be drawn through the uninterrupted regions between adjacent holding members to provide a decorative display of the scarf.

Another technical advantage of the present invention is that it provides an attractive way to embellish an outfit using a decorative element such as a scarf. A decorative ornament constructed according to the teachings of the present invention may be used as a hair bow. Alternatively, such a decorative ornament may be used to hold a gathered portion of a shirt. Furthermore, such a decorative ornament may be displayed on a lapel or other appropriate portion of an outfit.

Another technical advantage of the present invention is that it provides an interchangeable decorative ornament. The appearance of the interchangeable decorative ornament may be quickly and easily changed by removing the decorative element and inserting a replacement decorative element. In this manner, a single decorative ornament may be used to embellish many different outfits. Furthermore, the decorative ornament, as displayed, does not appear to be interchangeable.

Another technical advantage of the present invention is that it works with a wide variety of decorative fabric elements. For example, scarves of various shapes and sizes may be easily substituted and displayed in a decorative ornament constructed according to the teachings of the present invention.

Another technical advantage of the present invention is that a single decorative fabric element may be stylized in a number of different configurations. For example, the decorative element may be threaded through the holding elements and puffed-out through the uninterrupted regions. Alternatively, the decorative element may be tied to the holding members. Furthermore, multiple decorative elements may be displayed at one time. Furthermore, the decorative element displayed in the decorative ornament may be coupled with another scarf worn by a user.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein.

DETAILED DESCRIPTION OF THE INVENTION

Figures 1, 2A, 2B, 3:
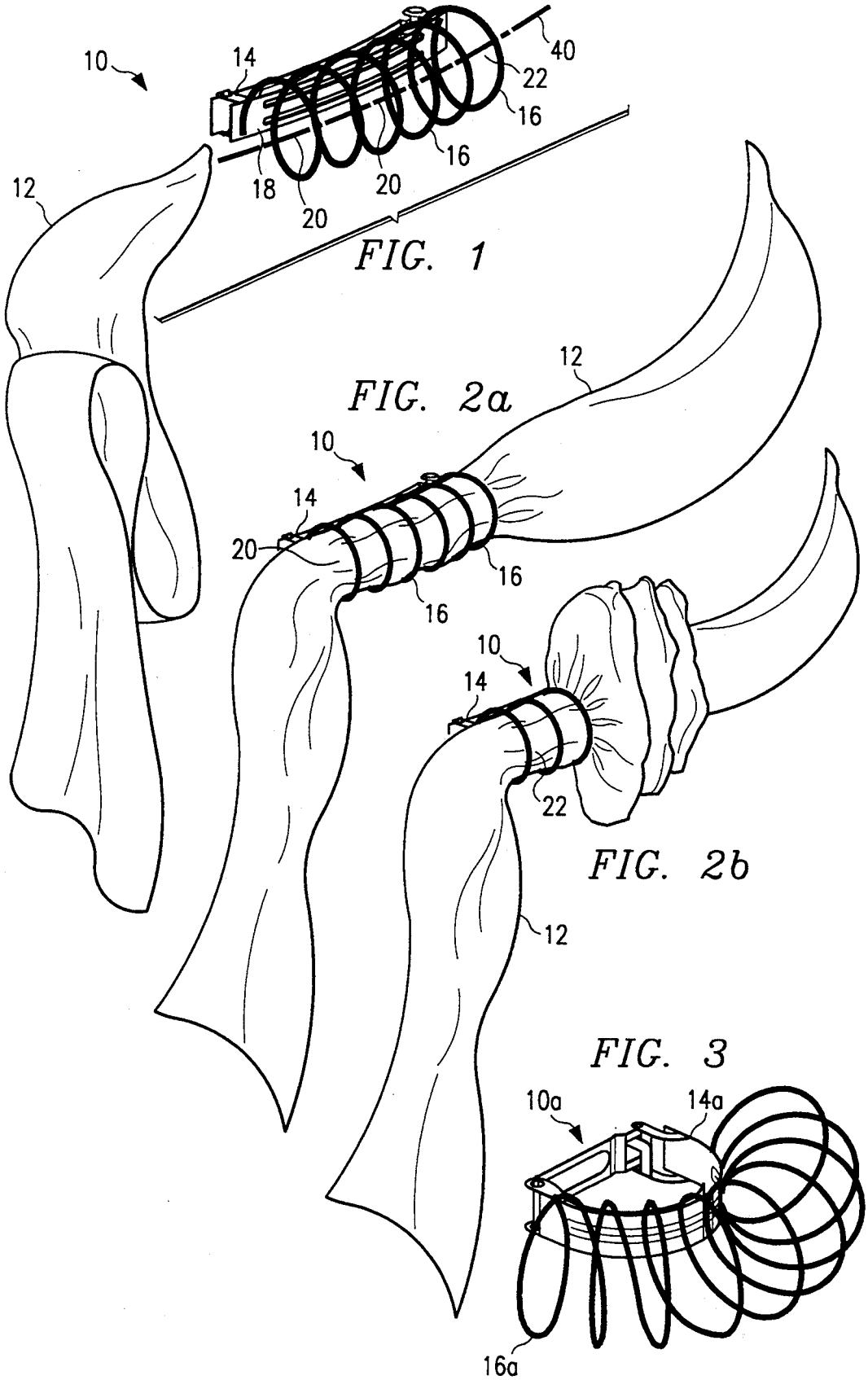
FIG. 1 is an exploded perspective view of one embodiment of a decorative ornament constructed according to the teachings of the present invention.
FIGS. 2*a*–2*d* illustrate a method for using the decorative ornament of FIG. 1 according to the teachings of the present invention.
FIG. 3 is a perspective view of another embodiment of a decorative ornament constructed according to the teachings of the present invention.

FIG. 1 illustrates one embodiment of a decorative ornament indicated generally at 10 and constructed according to the teachings of the present invention. Decorative ornament 10 may be used to display a decorative element 12. By way of example, and not by way of limitation, decorative element 12 may comprise, for example, a scarf, a ribbon, or any other appropriate decorative fabric for ornamenting an outfit. Furthermore, decorative element 12 may comprise any appropriate shape for use with decorative ornament 10 such as, for example, a square, a rectangle, an oval or any other appropriate shape. Additionally, decorative element 12 may comprise a fabric element commonly referred to as a "scrungie." Furthermore, decorative element 12 may comprise a plurality of individual decorative fabric elements.

Decorative ornament 10 is interchangeable. Decorative element 12 may be removed from decorative ornament 10 and replaced with another decorative element 12. Therefore, decorative ornament 10 may be used with various scarves or other decorative elements to match or work with various outfits or hairstyles. Decorative ornament 10 comprises a coupling member 14 for affixing decorative ornament 10 for display, and a plurality of holding members 16 for holding decorative element 12 in decorative ornament 10.

Coupling member 14 may be used to attach decorative ornament 10 for display. For example, coupling member 14 may comprise a barrette as shown in FIG. 1 for coupling decorative ornament 10 to a user's hair. Alternatively, coupling member 14 may comprise any other appropriate coupler to attach decorative ornament 10 to a user's hair or outfit.

Decorative ornament 10 further comprises a plurality of holding members 16 for holding decorative element 12 in decorative ornament 10. Holding members 16 are coupled to a surface 18 of coupling member 14. Each holding member 16 forms an opening 20 for receiving decorative element 12 as described with respect to FIGS. 2*a* through 2*d* below. Holding members 16 are spaced apart by an appropriate distance to form uninterrupted regions 22 between adjacent holding members 16 opposite surface 18. The distance between holding members 16 may be chosen to allow decorative element 12 to be drawn between adjacent holding members 16. It is noted that the distance separating holding members 16 may be varied along the length of decorative ornament 10. Holding members 16 may comprise, for example, a continuous spiral coil. Furthermore, holding members 16 may comprise, for example, a flexible material such as a pliable metal or plastic. Alteratively, holding members 16 may be rigid.

Figure 2C:
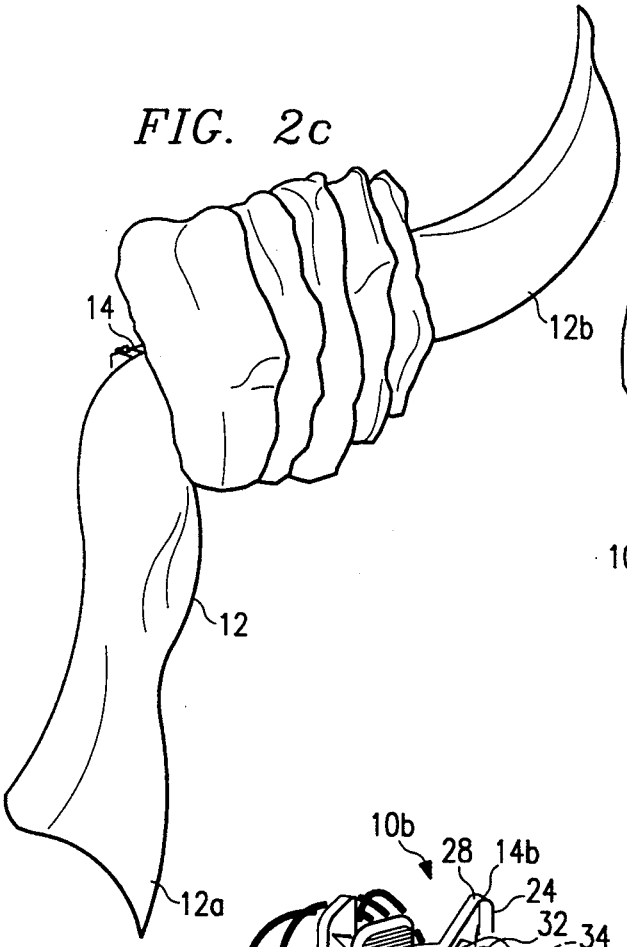
Figure 2D:
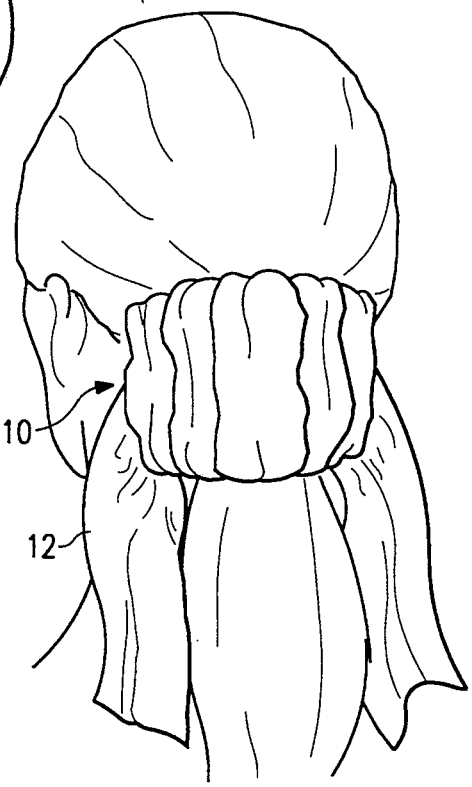

In operation, decorative ornament 10 may be used as shown in FIGS. 2*a* through 2*d*. As shown in FIG. 2*a*, decorative element 12 may be threaded through openings 20 of holding members 16. Decorative element 12 may be folded before being passed through openings 20. Decorative element 12 may, for example, be pulled through openings 20 of decorative ornament 10 such that decorative element 12 is centered on decorative ornament 10. As shown in FIG. 2*b*, decorative element 12 may be drawn through uninterrupted regions 22 of holding members 16 to provide a puffed-out decorative appearance. In this manner, decorative element 12 may block holding members 16 and coupling member 14 from view. Decorative element 12 may be drawn through uninterrupted regions 22 beginning at approximately the center of decorative ornament 10. Subsequently, decorative element 12 may be drawn through uninterrupted regions 22 progressively closer to each end of decorative ornament 10. Alternatively, decorative element 12 may not be centered in decorative ornament 10. Rather, decorative element 12 may be pulled through openings 20 so that an appropriate length of decorative element 12 extends beyond one end of decorative ornament 10. Subsequently, decorative element 12 may be drawn through uninterrupted regions 22 beginning at the end of decorative ornament 10 with the appropriate length of decorative element 12 extending therefrom. FIG. 2*c* illustrates decorative ornament 10 with decorative element 12 ready for display. It is noted that portions 12*a* and 12*b* of decorative element 12 may be hidden from view by being tucked into appropriate holding members 16. Alternatively, portions 12*a* and 12*b* may be used to attach to a scarf or other portion of a user's outfit. Decorative ornament 10 may be coupled to, for example, a user's hair by coupling member 14 as shown in FIG. 2*d*. Alternatively, decorative ornament 10 may be appropriately coupled to a user's outfit.

FIGS. 3 through 7 illustrate various alternative embodiments of decorative ornament 10. Each embodiment may be used with decorative element 12 of FIG. 1. For example, FIGS. 3 through 7 illustrate various changes to coupling member 14 and holding members 16. It is noted that these embodiments are by way of example and not by way of limitation. Furthermore, each embodiment of FIGS. 3 through 7 may be used in a manner similar to that described with respect to FIGS. 2*a* through 2*d*.

In FIG. 1, coupling member 14 is shown as a barrette. Alternatively, coupling member 14 may comprise any other appropriate device for displaying decorative ornament 10 in the user's hair or on a user's outfit. For example, FIG. 3 illustrates a decorative ornament indicated generally at 10*a* having a coupling member 14*a* and constructed according to the teachings of the present invention. Coupling member 14*a* comprises a barrette substantially forming a semi-circle.

Figure 4:
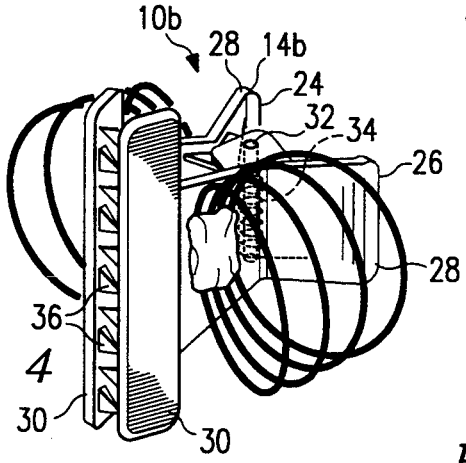
FIG. 4 is a perspective view of another embodiment of a decorative ornament constructed according to the teachings of the present invention.

Another embodiment of a coupling member 14 is shown in FIG. 4. FIG. 4 illustrates an embodiment of a decorative ornament indicated generally at 10*b* and constructed according to the teachings of the present invention. Decorative ornament 10*b* comprises a coupling member 14*b*. Coupling member 14*b* comprises a clip. Clip 14*b* is shown by way of example and not by way of limitation. Alternatively clip 14*b* may comprise any other appropriate clip for use in displaying a scarf. Clip 14*b* comprises first and second arms 24 and 26, respectively. Each arm comprises first and second portions 28 and 30, respectively. Furthermore, a rod 32 passes through first portion 28 of each of arms 24 and 26. Additionally, rod 32 passes through a spring 34 such that spring 34 biases second portion 30 of each of arms 24 and 26 together. Finally, clip 14*b* comprises a plurality of teeth 36 spaced apart along second portion 30 of arms 24 and 26. Clip 14*b* may, for example, be attached to a ponytail in a user's hair or may be used to grip a shank of hair. Alternatively, clip 14*b* may be used to attach decorative ornament 10*b* so as to gather a portion of a user's shirt or other article of clothing.

Figure 5:
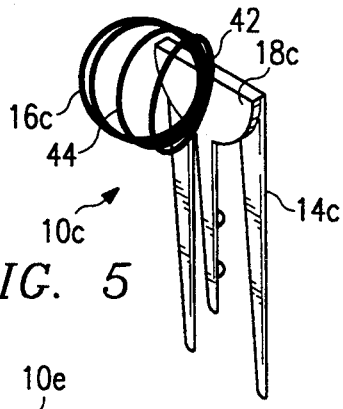
FIG. 5 is a perspective view of another embodiment of a decorative ornament constructed according to the teachings of the present invention.

FIG. 5 illustrates another embodiment of a decorative ornament indicated generally at 10*c* and constructed according to the teachings of the present invention. Decorative ornament 10*c* comprises coupling member 14*c*. Coupling member 14*c* may comprise, for example, a pin as described in U.S. Pat. No. 5,251,650. Alternatively, coupling member 14*c* may comprise any other appropriate pin for coupling a decorative ornament for display on a user's hair or outfit.

Figure 6:
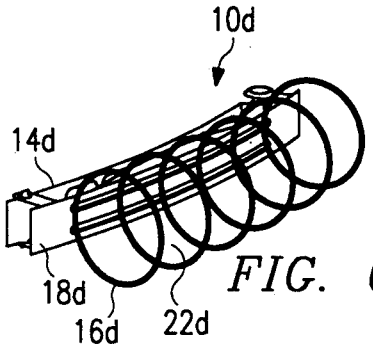
FIG. 6 is a perspective view of another embodiment of a decorative ornament constructed according to the teachings of the present invention.

In FIG. 1, holding member 16 is shown as a continuous spiral coil. Alternatively, holding member 16 may comprise any other appropriate device for holding decorative element 12 for display. For example, FIG. 6 illustrates another embodiment of a decorative ornament indicated generally at 10*d* and constructed according to the teachings of the present invention. Holding members 16*d* comprise a plurality of individual loops. Alternatively, holding members 16*b* may comprise any appropriate shapes such as, for example, squares, triangles, or other appropriate geometric shapes. Holding members 16*d* are coupled to surface 18*d* of coupling member 14*d*. Holding members 16*d* may be spaced apart an appropriate distance such that decorative element 12 may be drawn through uninterrupted regions 22*d*. As shown, holding members 16*d* are oriented parallel to a transverse axis of surface 18*d*. Alternatively, holding members 16*d* may be angled with respect to the transverse axis.

Figure 7:
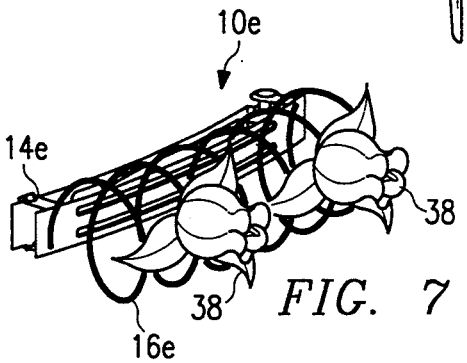
FIG. 7 is a perspective view of another embodiment of a decorative ornament constructed according to the teachings of the present invention.

FIG. 7 illustrates another embodiment of a decorative ornament indicated generally at 10*e* and constructed according to the teachings of the present invention. Decorative ornament 10*e* comprises holding members 16*e*. A plurality of display elements 38 may be coupled to extend from selected holding members 16*e*. Display elements 38 may be removably attached to holding members 16*e*. Alternatively display elements 38 may be fixed to holding members 16*e*. Display elements 38 are operable to be visible when decorative element 12 is inserted into decorative ornament 10*e* as described with respect to FIGS. 2*a* through 2*d*.

Additional variations may be made to decorative ornament 10 of FIG. 1 without departing from the teachings of the present invention. For example, holding members 16 may be coupled to coupling member 14 in several different ways. For example, holding members 16 in FIG. 1 are coupled to coupling member 14 such that openings 20 of holding members 16 form a common axis 40. Alternatively, FIG. 5 illustrates holding members 16*c* coupled to coupling member 14*c* to provide a flared out configuration. In FIG. 5, holding members 16*c* each comprise first and second opposite portions 42 and 44, respectively. Each first portion 42 is coupled to coupling member 14*c* at surface 18*c* and are separated by a first predetermined appropriate distance. Each second portion 44 of holding members 16*c* are separated by second predetermined distance. The second predetermined distance is greater than the first predetermined distance to provide the flared out configuration. The second predetermined distance may be chosen to allow a decorative element to be drawn between adjacent holding members 16*c*.

Figure 8:
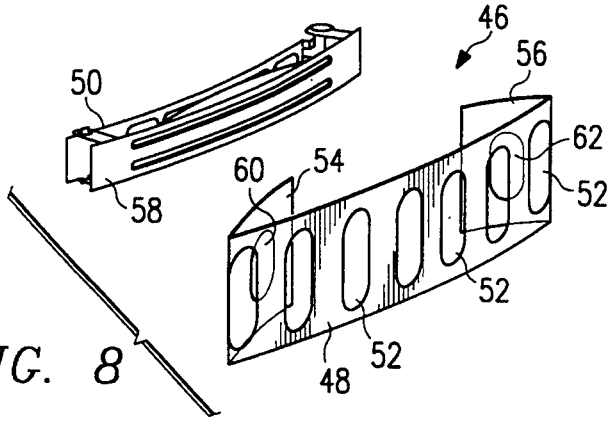
FIG. 8 is an exploded perspective view of another embodiment of a decorative ornament constructed according to the teachings of the present invention.

FIG. 8 illustrates another embodiment of a decorative ornament indicated generally at 46 and constructed according to the teachings of the present invention. Decorative ornament 46 comprises a removable holding member 48 and a coupling member 50. As shown, coupling member 50 comprises a barrette. Alternatively, coupling member 50 may comprise any appropriate device for coupling an ornament to a user's hair or a user's outfit. For example, coupling member 50 may be replaced with any of the various coupling members shown in FIGS. 1, and 3 through 7.

Removable holding member 48 may comprise, for example, a substantially rectangular body having a plurality of slots 52 formed therein. Slots 52 may comprise substantially rectangular slots formed parallel to a transverse axis of removable holding member 48. Alternatively, slots 52 may comprise any other appropriate shape. Additionally, removable holding member 48 may comprise first and second end portions 54 and 56, respectively. End portions 54 and 56 may be folded such that a length of removable holding member 48 is coextensive with surface 58 of coupling member 50. Additionally, first and second openings 60 and 62 may be formed in first and second portions 54 and 56, respectively. Openings 60 and 62 may be used to attach removable holding member 48 to coupling member 50.

Figure 9A:
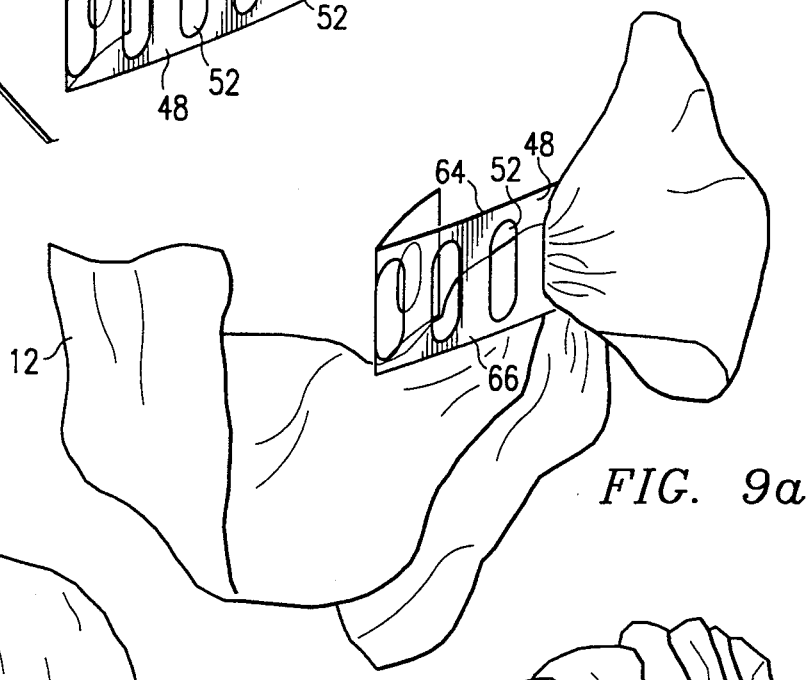
FIGS. 9*a*–9*c* illustrate a method of using the decorative ornament of FIG. 8 according to the teachings of the present invention.
Figure 9C:
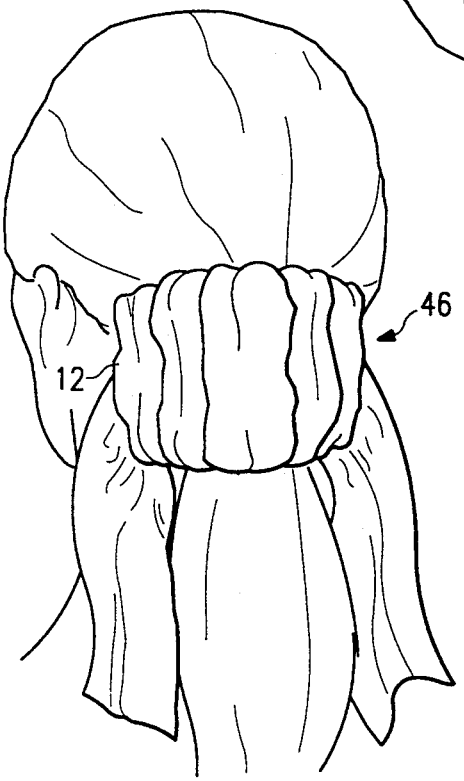
Figure 9B:
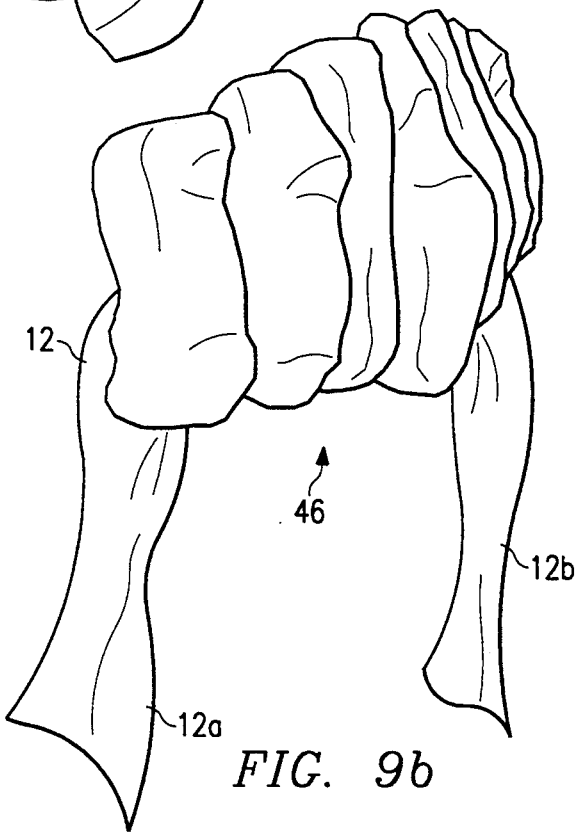

In operation, decorative element 12 may be displayed using decorative ornament 46 as shown in FIGS. 9*a* through 9*c*. As shown in FIG. 9*a*, decorative element 12 may be woven onto removable holding member 48 through slots 52. Decorative element 12 may be pulled tight to surface 64 of removable holding member 48. Additionally, decorative element 12 may be allowed to form a puffed-out appearance on surface 66 of removable holding member 48. FIG. 9*b* illustrates decorative element 12 completely woven into removable holding member 48. As shown in FIG. 9*c*, removable holding member 48 may be attached to coupling member 50 using opening 60 and 62 in first and second portions 54 and 56 of removable holding member 48. As with FIG. 2*c*, portions 12*a* and 12*b* may be hidden from view or may be used with another portion of the user's outfit. Finally, decorative ornament 46 may be displayed in a user's hair as shown in FIG. 9*c*. Alternatively, decorative ornament 46 may be attached to a shirt, a lapel, or any other appropriate portion of an outfit.

Although the present invention has been described in detail, it should be understood that various changes, substitutions and alterations can be made hereto without departing from the spirit and scope of the invention as defined by the appended claims. For example, holding members 16 of FIG. 1 may be removably coupled to coupling member 14. Additionally, the type of coupling member 12 may be varied without departing from the scope and teaching of the present invention. Finally, the shape of holding members 16 may be altered to be square, semicircles, half-moons, or any other appropriate shape. Furthermore, coupling member 14 may comprise an appropriate head band having holding members 16 coupled thereto.

What is claimed is:

1. A decorative ornament for displaying at least one removable decorative element, comprising:

first and second opposing arms for affixing the decorative ornament to a user for display, said arms each having first and second portions;

a spring having first and second protruding end portions;

a rod passing through said first portion of each of said arms and said spring such that said first and second protruding end portions of said spring push on said first portions of said arms so as to bias said second portion of said arms together;

a plurality of loops extending from an outer surface of each of said arms, said loops spaced apart by uninterrupted regions between adjacent loops such that the decorative element may pass through said uninterrupted regions between adjacent holding members.

2. The decorative ornament of claim 1, wherein said arms further comprise a plurality of teeth spaced apart along said second portion of said arms.

3. The decorative ornament of claim 1, wherein said plurality of loops comprise a spiral coil.

4. The decorative ornament of claim 1, wherein said plurality of loops comprise first and second opposite portions, each of said first portions coupled to said arms and separated by a first predetermined distance, each of said second portions separated by a second predetermined distance, greater than said first predetermined distance.

5. The decorative ornament of claim 1, and further comprising a plurality of display elements fixedly attached to said plurality of loops such that said display elements are visible when said decorative element is drawn between adjacent loops.

6. The decorative ornament of claim 1, wherein said plurality of loops are flexible.

* * * * *

UNITED STATES PATENT AND TRADEMARK OFFICE

CERTIFICATE OF CORRECTION

PATENT NO. : 5,441,061

DATED : August 15, 1995

INVENTOR(S) : Jordan, et al.

It is certified that error appears in the above-identified patent and that said Letters Patent is hereby corrected as shown below:

Column 7, line 10, after "adjacent" delete "holding members" and insert -- loops --.

Signed and Sealed this

Nineteenth Day of December, 1995

*Attest:*

Bruce Lehman

BRUCE LEHMAN

*Attesting Officer*

*Commissioner of Patents and Trademarks*